US006155351A

United States Patent [19]

Breedlove et al.

[11] Patent Number: 6,155,351

[45] **Date of Patent: *Dec. 5, 2000**

[54] FOAM BASED PRODUCT SOLUTION DELIVERY APPARATUS

[75] Inventors: John Breedlove, Jamestown; Dennis Edward Smagac, Boulder, both of Colo.

[73] Assignee: Intelagard, Inc., Bouler, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 09/119,374

[22] Filed: Jul. 20, 1998

Related U.S. Application Data

[63] Continuation-in-part of application No. 08/786,974, Jan. 24, 1997, which is a continuation of application No. 08/448,808, May 24, 1995, Pat. No. 5,623,995.

[51] Int. Cl.[7] ..... A62C 5/02

[52] U.S. Cl. ..... 169/14; 169/9; 169/85

[58] Field of Search ..... 169/14, 15, 9, 169/30, 71, 74, 76, 77, 85, 44, 45, 46

[56] References Cited

U.S. PATENT DOCUMENTS

| | | | |
|---|---|---|---|
| 3,037,887 | 6/1962 | Brenner et al. | 134/22.18 |
| 3,255,824 | 6/1966 | Rodgers | 169/31 |
| 3,337,195 | 8/1967 | Farison | 169/15 |
| 3,342,271 | 9/1967 | Anthony, Jr. | 169/15 |
| 3,592,269 | 7/1971 | Stults | 169/9 |
| 3,709,302 | 1/1973 | Stults | 169/9 |
| 3,721,299 | 3/1973 | Roessler | 169/31 |
| 3,750,754 | 8/1973 | Stults | 169/9 |
| 3,802,511 | 4/1974 | Good, Jr. | 169/30 |
| 4,093,188 | 6/1978 | Horner | 366/336 |
| 4,254,833 | 3/1981 | Perry | 169/76 |
| 4,729,434 | 3/1988 | Rohrbach | 169/24 |
| 4,981,178 | 1/1991 | Bundy | 169/9 |
| 5,255,747 | 10/1993 | Teske et al. | 169/15 |
| 5,476,146 | 12/1995 | Brown | 169/14 X |
| 5,623,995 | 4/1997 | Smagac | 169/30 |

FOREIGN PATENT DOCUMENTS

| | | | |
|---|---|---|---|
| 0 088 029 A1 | 9/1983 | European Pat. Off. | B05B 7/32 |
| 2 353 314 | 5/1977 | France | A62C 5/00 |
| 2 246 294 | 1/1992 | United Kingdom | A62C 5/02 |
| WO 94/07570 | 4/1994 | WIPO | A62C 35/00 |
| WO 94/23798 | 10/1994 | WIPO | A62C 5/02 |

*Primary Examiner*—Andres Kashnikow
*Attorney, Agent, or Firm*—Duft, Graziano & Forest, P.C.

[57] ABSTRACT

The foam based product solution delivery apparatus is simple in structure and operation and makes use of pressurized gas to power a pressure operated pump to draw the water/foam-concentrate/product(s) from supply tank(s) and propel the resultant solution (foam fluid), with pressurized gas injected therein, through an agitation apparatus that mechanically agitates the water/foam/product(s) solution to create the foam based product solution for transmission to the foam delivery apparatus. Interposed in the delivery apparatus between the pump and the outlet end of the hose, the agitation apparatus functions to significantly increase the foam expansion prior to delivery of the foam through the delivery apparatus. The agitation apparatus comprises an exterior housing inside of which is mounted a set of motionless mixing blades that function to mix and expand the foam. The agitation apparatus not only produces a high expansion of the foam but it also produces a more consistent bubble structure which enhances both the longevity and adhesion of the foam when applied to a structure.

41 Claims, 13 Drawing Sheets

FOAM BASED PRODUCT SOLUTION DELIVERY APPARATUS

CROSS REFERENCE TO RELATED APPLICATIONS

This application is a continuation-in-part of U.S. patent application Ser. No. 08/786,974 titled "Fire Suppressant Foam Generation Apparatus," filed Jan. 24, 1997, which is a continuation of U.S. Ser No. 08/448,808 U.S. Pat. No. 5,623,995 titled "Fire Suppressant Foam Generation Apparatus," filed May 24, 1995.

FIELD OF THE INVENTION

This invention relates to apparatus for generating and delivering a product solution of precise concentration and containing a precisely determined quantity of product for use in many applications, including but not limited to: frost protection, insect control, weed control, plant fertilization, fire fighting, chemical application, and the like, wherein the carrier used is an controllable expansion foam.

PROBLEM

It is a problem in many fields to apply a precisely controllable quantity and/or concentration of a product to a desired application site. The product that is to be delivered in many cases is in the form of a water-based solution that is preferably sprayed on to the application site to thereby provide an efficient application of a limited quantity of the product. This is desirable because the product is typically expensive and/or can have deleterious effects if applied in concentrated form to the application site. One problem with such a system is that it is difficult to accurately ascertain the coverage of the application site with the product, since there is typically only subtle visual indications of the presence of the product solution on the application site. Another problem is that it is difficult to precisely control the quantity of product applied to the application site since the volume of product solution that is delivered is small and not readily apparent. Yet another problem is that the product, being a water-based solution, has low viscosity and does not adhere well to vertically oriented surfaces. Another problem is that it is difficult to control the evaporation rate of the product solution. There are further problems that are numerous and specific to the particular field of use of the product that also make the design of a product solution delivery system difficult. These include, but are not limited to: product toxicity, need to apply the product solution in an enclosed space, tendency of the product solution to block small diameter apertures, portability of the product solution delivery system, reliability of the product solution delivery system, flexibility of the product solution delivery system architecture for use in many applications, simplicity of use of the product solution delivery system, cost of the product solution delivery system. Thus, the task of applying a product in solution form to a desired application site is full of problems, which problems present technology in the field product solution delivery systems has had little success in addressing.

There are numerous product solution delivery systems in the diverse fields of use for product solutions, whether water-based solutions or solutions based upon other carriers. The product application system can comprise mechanical product solution spraying system wherein a tank or other source of the product solution is pumped under pressure through a delivery system comprising a hose that is terminated in a spray nozzle. This is a common and simple product solution delivery system architecture that can incorporate many varieties of elements in terms of: spray nozzles, pumps, product solution reservoirs, control valves, and the like. Of particular interest in these systems is the fact that the source of energy used to operate these systems include: fossil fuel powered combustion engines, electrically powered motors, hand operated pumps, and pressurized gas powered pumps/pressure vessels.

One type of water-based solution that is of particular interest is the class of foams that are typically used for fire fighting. The Class A foam is in common use and comprises a foam that is specially designed for use on Class A fires. The definition of Class A fires is a fire in ordinary combustible materials, such as wood, cloth, paper, rubber, and many plastic products. The Class A foams are characterized by relatively stable bubbles that are formed by a liquid of superior wetting ability. Hydrocarbon surfactants or soaps are the major ingredients of a Class A foam concentrate. The surfactants reduce the water surface tension to provide improved spreading and penetrating capability to the water. The foam also acts as a vapor suppressant to prevent or delay ignition of combustible materials. An alternative type of fire suppressant foam is the aqueous film forming foams (AFFF) that are foam concentrates with the addition of fluorine to further reduce the water's surface tension over that of the Class A foams. However, the fluorine is not biodegradable and the use of AFFF is typically in the area of petroleum fires. The Class A and AFFF foams can be delivered either by the use of special nozzles that function to aerate the premixed foam solution upon discharge from the nozzle or by a compressed air foam system "CAFS" that is a complete system consisting of a foam concentrate proportioner, water pump and air compressor. The water pump is fossil fuel driven and draws a large supply of water from a reservoir and, as the water is pumped through the CAFS system, the foam concentrate proportioner injects the foam concentrate into the stream of water. Further downstream, a fossil fuel driven air compressor injects compressed air into the line carrying the water and foam concentrate mixture and the resultant foam is applied via the use of a nozzle attached to the end of the hose. CAFS generate the foam in the hose rather than at the hose nozzle. Therefore, only ball valves or smooth bore tips are required in a CAFS system. A difficulty with the existing foam fire suppressant systems is that they rely on the use of fossil fuel powered pumps and air compressors, thereby limiting the mobility of the units to only sites that are accessible by large pumper trucks. Furthermore, these systems cannot be used inside a closed structure due to the exhaust from the fossil fuel power plants used in these systems. The reliability of the fossil fuel power plants may be good, but a superior reliability is desired in this application. Finally, the expansion ratios that are available in these units are limited because the expansion occurs in the hose itself and the user typically has little control of the expansion ratio on a dynamic basis.

SOLUTION

The above described problems are solved and a technical advance achieved in the field by the present foam based product solution delivery apparatus. This apparatus functions to generate a substantially uniform, fine bubble structure foam of controllable concentration, that is used as the carrier (or the product itself) to enable the precise delivery of product(s) of precise concentration to a product application site. The foam based product solution delivery apparatus makes use of a commercially available low moisture content foam concentrate in conjunction with novel foam generation and application apparatus to provide an inexpensive, reliable and portable foam based product solution delivery apparatus that can be used in a plethora of applications to deliver a wide range of products.

This foam based product solution delivery apparatus is simple in structure and operation and makes use of pressurized gas to power a pressure operated pump to draw the water/foam-concentrate/product(s) from supply tank(s) and propel the resultant solution, with pressurized gas injected therein, through an agitation apparatus that mechanically agitates the water/foam/product(s) solution to create the foam based product solution prior to transmission to the foam delivery apparatus. Interposed in the delivery apparatus between the pump and the outlet end of the hose, the agitation apparatus functions to significantly increase the foam expansion prior to delivery of the foam through the delivery apparatus. The agitation apparatus comprises an exterior housing inside of which is mounted a set of motionless mixing blades that function to mix and expand the foam to a degree heretofore not seen in foam generation. The agitation apparatus not only produces a high expansion of the foam but it also produces a more consistent bubble structure which enhances both the longevity and adhesion of the foam when applied to a structure.

This foam based product solution delivery apparatus is inexpensive, reliable, lightweight in construction, simple in architecture and can be implemented in a unit that is sufficiently compact to be installed on a lightweight utility vehicle, such as a four-wheel drive pick-up truck, or mounted on a cart, or implemented in the form of a backpack unit. This apparatus also does not require a large capacity source of water to create the foam based product solution that is applied to the application site, since the foam based product solution delivery apparatus provides a significant and controllable expansion to the foam/water/product(s) concentrate.

The use of the pressurized gas operated pump and the agitation apparatus to create a highly expanded foam eliminates the need for pressurized water as a propellant. This has multiple benefits, including the reduction in the moisture content of the foam and avoiding the need for complex water pumping apparatus to create a stream of pressurized water. The elimination of water as a delivery agent thereby renders this apparatus independent of a large supply of water that is typically needed in existing foam systems. In addition, since water is an incompressible medium, its storage and delivery cannot be improved by pressurization, whereas the use of an inert gas as both the product propellant and pump motive power provides a great opportunity for storage efficiency, since the gas can be pressurized to extremely high levels, thereby efficiently storing a vast quantity of propellant in a small physical space. Control of the flow of the pressurized gas and water/foam/product(s) solution is accomplished by way of simple check valves and pressure regulators, thereby eliminating the complexity of the foam generation apparatus presently in use. This novel apparatus can therefore be implemented inexpensively in a compact implementation unknown in the prior art.

DETAILED DESCRIPTION

System Architecture

Figure 1:
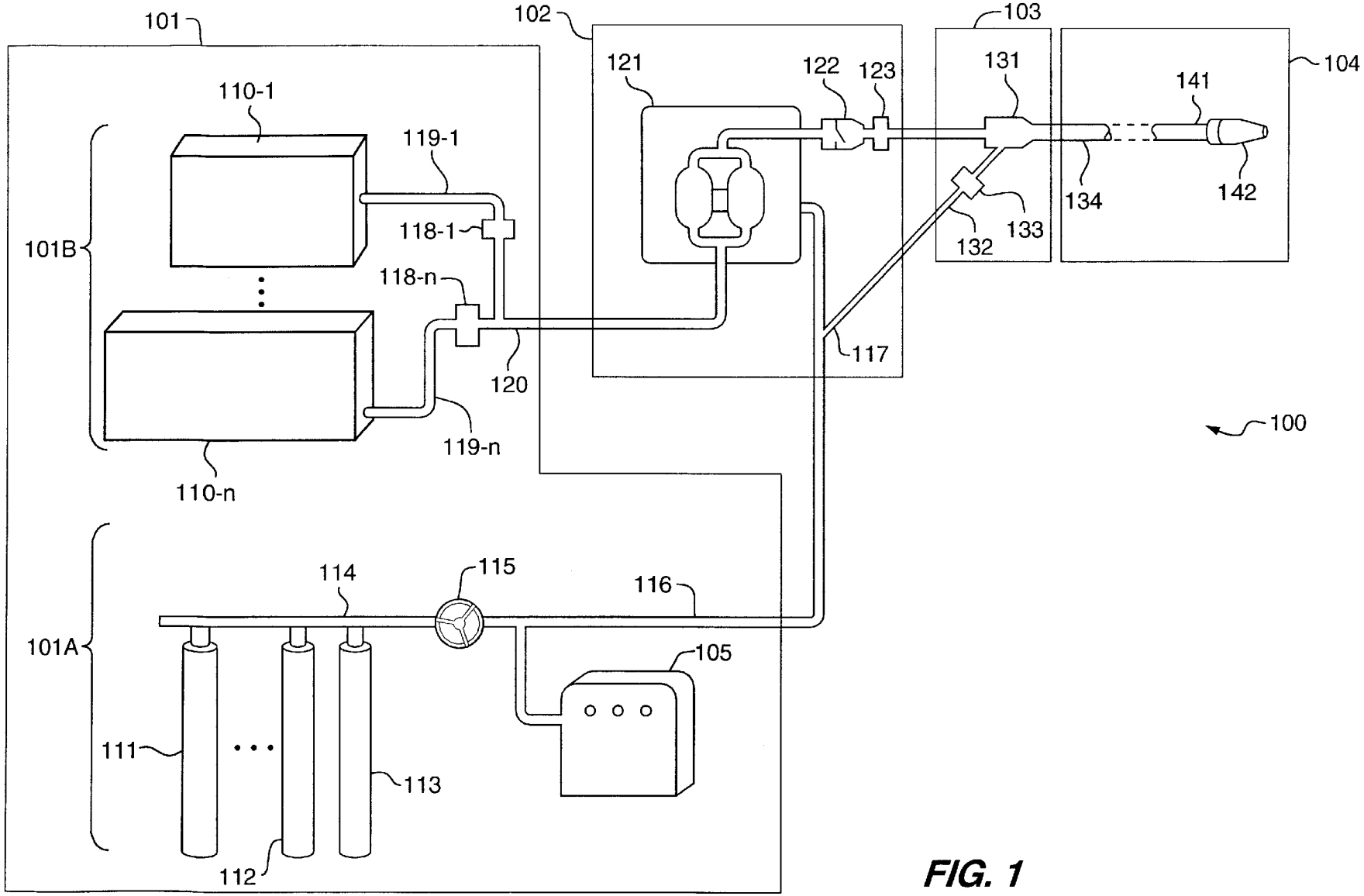
FIG. 1 illustrates in block diagram form the overall architecture of the present foam based product solution delivery system.

The present foam based product solution delivery apparatus is illustrated in block diagram form in FIG. 1 to disclose the basic architecture of this system. The present foam based product solution delivery apparatus 100 comprises a source of foam fluid 101 and a pump 102 that functions to draw the foam fluid from the source of foam fluid 101 to create a flow of the foam fluid. This flow of foam fluid is processed by an agitating apparatus 103 that functions to inject pressurized gas into the flow of foam fluid and agitate the flow of foam fluid to thereby expand the foam fluid to create the resultant foam based product solution, which is transported by the delivery apparatus 104 to enable the user to apply the foam based product solution to the desired application site. This apparatus is a completely passive system in that it does not require the use of electricity or fossil fuel powered pumps for operation. The foam based product solution delivery apparatus 100 is powered by "stored air energy" in the form of pressurized gas that is stored in one or more pressure bottles 111–113. The pressurized gas is injected into the flow of foam fluid and is also used to power the pump 102. Thus, the foam based product solution delivery apparatus 100 is self contained and can be implemented in a portable form, such as a backpack, and can be used inside of closed structures, since there are no exhaust fumes emitted by the foam based product solution delivery apparatus 100. Furthermore, the use of the pressurized gas simplifies the operation of the unit and increases reliability, since there are fewer components that can fail and the components used are far more reliable than fossil fuel powered foam units.

Theory of Operation

Figure 17:
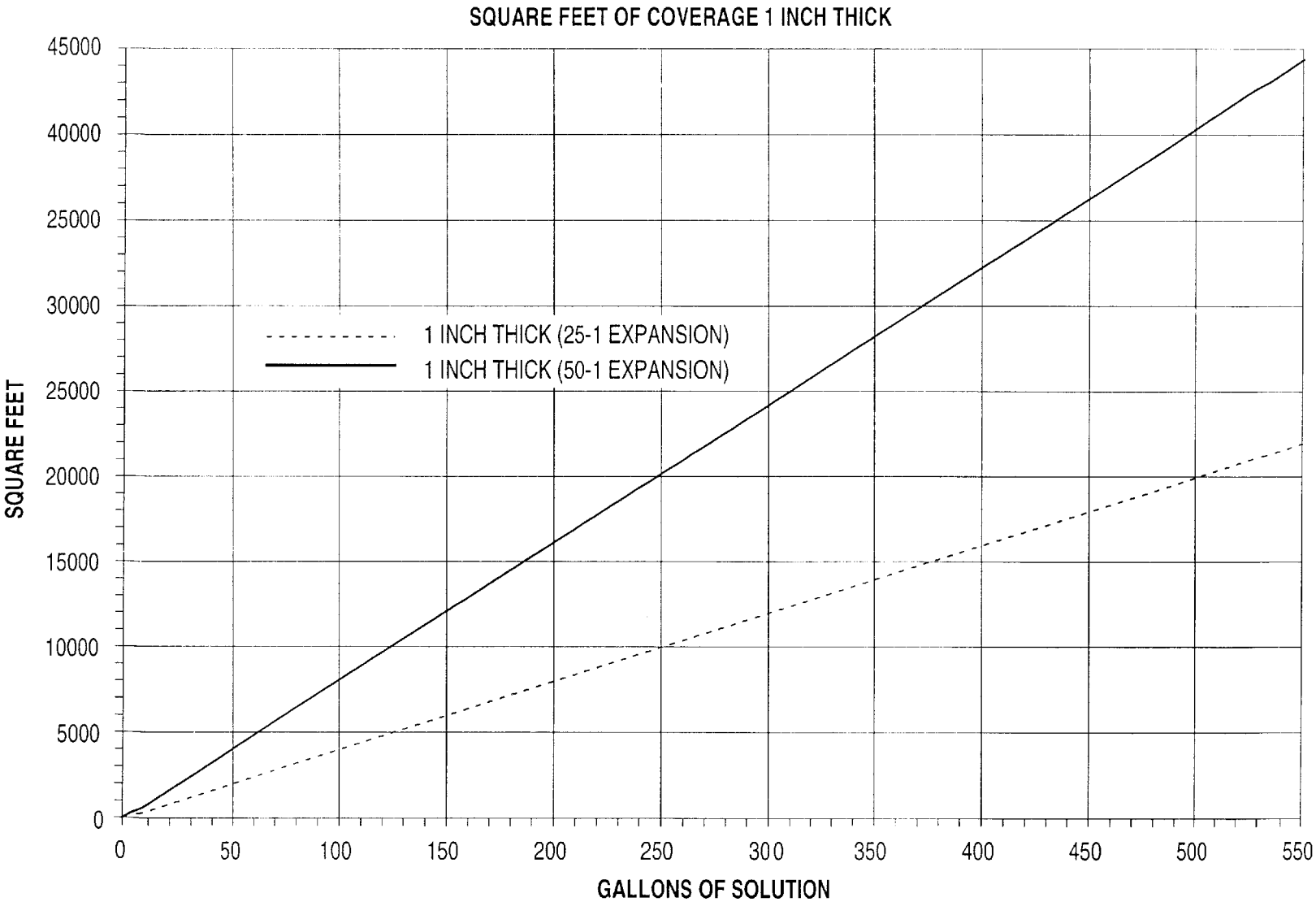
FIG. 17 illustrates a chart of coverage capability of the foam.

Foam is produced as a result of the combination of a base liquid, such as water, and a foam concentrate that forms a foam fluid. A pressurized gas is also added to the foam fluid to agitate the foam fluid to create the expanded foam and to deliver it through the delivery apparatus. The foam based product solution delivery apparatus 100 produces a dry foam mixture for use in many applications. The reduction in the fluid content of the foam is accomplished by the use of pressurized gas to create the agitation and pressurized delivery capability. Furthermore, the use of the pressurized gas eliminates the need for a large complex pumping apparatus to pump an incompressible fluid, such as water, that has been used in the past to agitate and supply the foam mixture to the spray nozzles. In a typical application, a 200 gallon tank of water/foam mixture can produce 10,000 gallons of water-based biodegradable foam without the need of complex pumping apparatus. The coverage provided by this foam is illustrated by the chart of FIG. 17. As is evident from this chart, a small amount of foam fluid covers a significant area. The significant expansion of the foam is obtained by the use of the agitation apparatus 103 which provides dramatic results in terms of agitating the foam fluid to produce the resultant substantially uniform and fine bubble structure in the foam.

The resultant foam can be used as the end product in applications such as fire suppression, since it has excellent fire suppression characteristic as described below. However, the foam can be used to apply any number of products to an application site. This can be accomplished by adding a controllable quantity of the product to the flow of foam liquid to create a foam-product solution. As the foam is expanded by the mechanical agitation provided by the agitating apparatus 103, the product is substantially uniformly dispersed throughout the foam. The expansion ratio of the foam can be precisely controlled and thus, the weight of the resultant foam as well as the concentration of the product delivered. The foam provides visual feedback to the user to indicate the area of coverage of the product. The foam itself is biodegradable and non-toxic and therefor does not impact the object to which it is applied. Various uses for the foam are described below to illustrate the diversity of uses and the significant benefits afforded by the present foam based product solution delivery apparatus 100.

In the foam based product solution delivery system 100 illustrated in FIG. 1, there are many alternative embodiments of each of the elements shown therein. The following discussion references one or more implementations of each of the basic elements, although there are variations too numerous to describe herein. Therefore in the interest of brevity, basic architectural choices are outlined and the implementation of each of these variations is subject to selection by one skilled in the art of the available technology to create a specific implementation of the system component.

Source of Foam Fluid

The first element described is the source of foam fluid 101. This component comprises both the source of pressurized gas 101A as well as storage tank(s) 101B for the various elements that comprise the foam fluid. The pressurized gas is stored in a highly pressurized condition in one or more bottles 111–113 that are interconnected via a manifold 114 and, optionally, generated by compressor 105. The output of the manifold 114 is applied through a pressure regulator 115 of conventional design to a supply line 116. The supply line 116 can supply one or more pumps 102 via junction 117, but for the purpose of simplicity of illustration, this additional apparatus is not replicated in FIG. 1. The pressurized gas can be any substantially non-reactive gas, such as nitrogen, although air makes an excellent choice because of its ready availability. In any case, the compressibility of gas is beneficial in that it enables the system to store a significant amount of energy to power the pump 102 in a small volume, without a significant weight penalty. Compressed gas apparatus are also more reliable and simple than fossil fuel powered apparatus.

Figure 18:
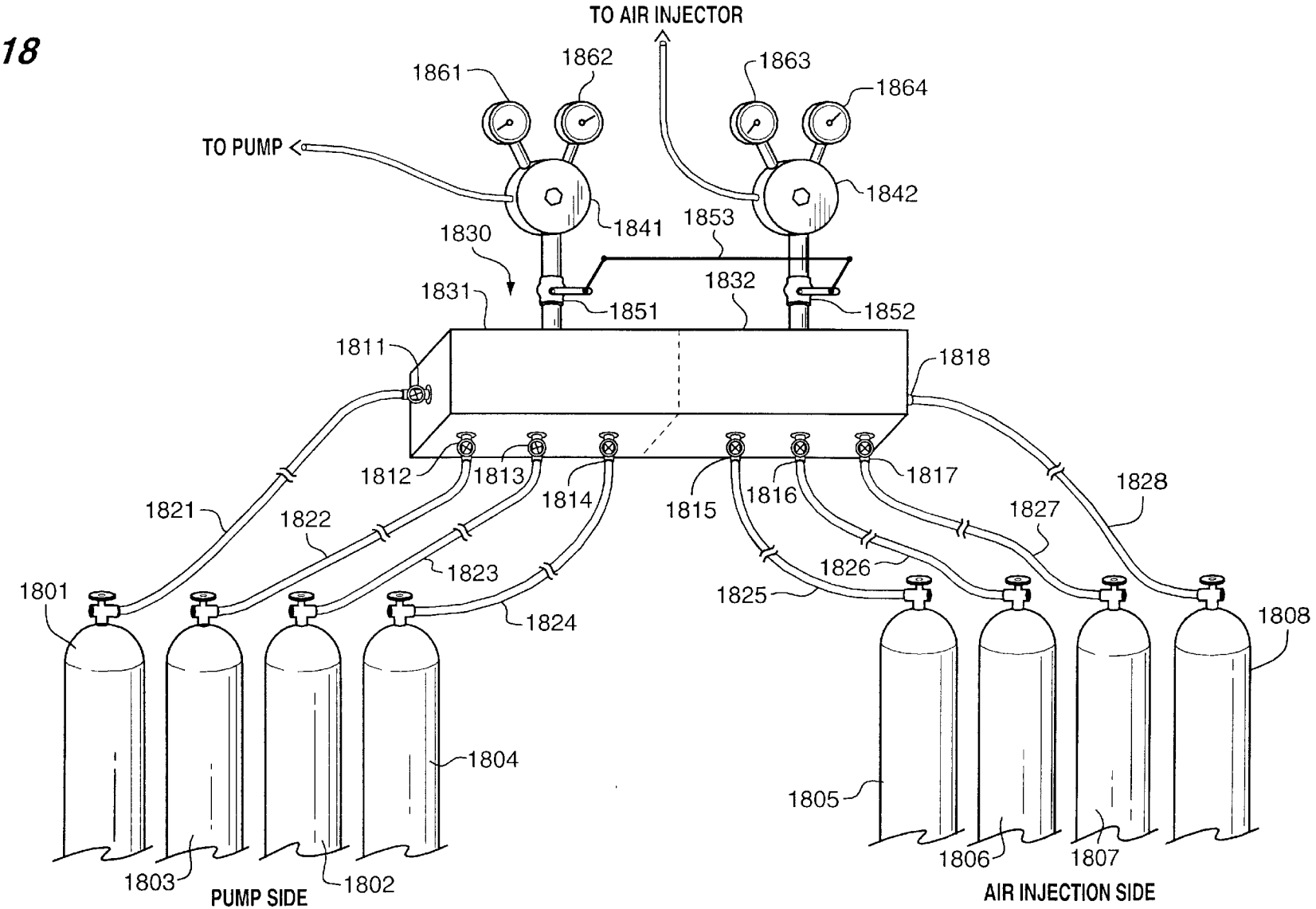
FIG. 18 illustrates a detailed view of a manifold system that can be used in the present foam based product solution delivery system.

The pressure regulator 115 is set to provide optimal flow rates for gas to operate pump 102 and to inject gas for foam expansion and bubble construction and to eliminate the need for the user to set the flow rates. FIG. 18 illustrates a detailed view of a manifold system that can be used in the present foam based product solution delivery system 100. In particular, a plurality of pressure bottles 1801–1808 are shown to provide the pressurized gas for the manifold 1830. The manifold itself can optionally be connected to the pressure bottles 1801–1808 via check valves 1811–1818 to prevent back flow of gas in any of the lines 1821–1828 that interconnect the pressure bottles 1801–1808 with manifold 1830. The manifold 1830 can either be a single unit or can be a pair of units 1831–1832 as shown in FIG. 18. A first of the manifold units 1831 supplies the pump 102, while the second manifold unit supplies the air injection in the agitation apparatus 103. Each of the manifold units 1831, 1832 includes a preset single or dual stage pressure regulator 1841, 1842 connected to the manifold units 1831, 1832 via respective high pressure ball valves 1851, 1852 which can be operated by a single interconnected lever 1853 to thereby precisely control the pressure of the gas supplied to the pump 102 and agitation apparatus 103 via a single control mechanism. The regulators 1831, 1832 typically are equipped with gauges 1861–1864 that indicate (1861, 1863) the pressures of the pressure bottles 1801–1808 and the output pressure (1862, 1864) of the preset dual stage pressure regulators 1841, 1842. Thus, operation of the system is effected by the operation of a single lever 1853.

The storage tanks 101B comprise one or more storage tanks 110-1 to 110-n connected via tank outlets 119-1 to 119-n to metering pumps 118-1 to 118-n that are used in combination to create the foam fluid that is supplied to the pump 102. There are numerous variations of this apparatus that can be used and the options are briefly described herein. Several determining factors are the number of tanks that can conveniently and cost effectively be incorporated into the particular variation of the foam based product solution delivery apparatus 100, as well as the reactivity of the various components that are used to create the foam fluid. Thus, a single tank can be used in the case of fire suppressant foam, where the foam concentrate is mixed in with the base liquid (water) in a single tank. In other instances, especially where multiple products are to be delivered by the foam based product solution delivery apparatus 100, either at different times or concurrently, there can be separate tanks for each product. Thus, in the case of herbicide or insecticide, a separate tank, such as 110-1, can be used to hold the product concentrate, while a second tank, such as 110-n, can hold the foam concentrate water solution. Alternatively, the water can be placed in one tank and the foam concentrate in another tank and the product(s) in individually designated tank(s). Each of the tanks that hold either the foam concentrate or the product(s) can be equipped with a metering pump 118 that operates to precisely inject a predetermined quantity of the contents of the associated tank into the line 12O that carries the foam fluid to the pump 102. The metering pump(s) can also be powered by the pressurized gas. Thus, the line 120 represents the input to pump 102, which creates a draw of the fluids from the various tanks due to its pumping action. Typical concentrations of the foam concentrate that are used in the foam fluid are a 3%–5% concentration for protein based foam, a 3%–6% concentration for AFFF foam, and a 0.1%–1% concentration for Class A foam. In addition, the tank for the water can include an internally mounted tank to contain and dump foam concentrate to form the foam fluid.

Foam Concentrate

A typical foam concentrate is sold by Chemonics Industries, Inc. under the trade name of "FIRE-TROL® FIREFOAM® 103". This foaming agent (foam concentrate) is a mixture of foaming and wetting agents in a non-flammable solvent. The concentrate is diluted with a fluid, such as water, to produce the water/foam mixture which expands into the resultant product when agitated by a propellant and delivered through an appropriate system of agitators, and properly dimensioned pipes or hoses, which further enhances the agitation.

Pressurized Gas Operated Pump

The pump 102 comprises a pressurized gas operated pump 121, such as a dual diaphragm pump, and a number of valves and mixing elements 122–123. The pressurized gas applied through supply line 116 can be used to power the pressurized gas driven pump 121 or an additional source of pressurized gas, such as air compressor 105, can be used to supply pressurized gas via line 151 to operate the pressurized gas driven pump 121. Alternatively, a hydraulically or mechanically driven pump, such as a power take off (PTO) driven pump, can be used in lieu of the pressurized gas driven pump 121, especially if this apparatus is mounted on a vehicle. In the embodiment of FIG. 1, the compressor can either be the primary source of the pressurized gas, with the stored air elements (bottles 111–113) being the fail-safe backup, or the compressor can be eliminated to implement a highly portable and lightweight system.

The pressurized gas functions to operate pump 121 to actively draw the water/foam mixture from storage tank(s) via line supply line 120 and output it through check valve 122 at a significantly increased pressure to water/foam mixture volume valve 123. The water/foam mixture volume valve 123 controls the flow of the water/foam mixture to thereby controllably regulate the water/foam and pressurized gas mixture that is provided to create the agitated foam mixture.

Figure 9:
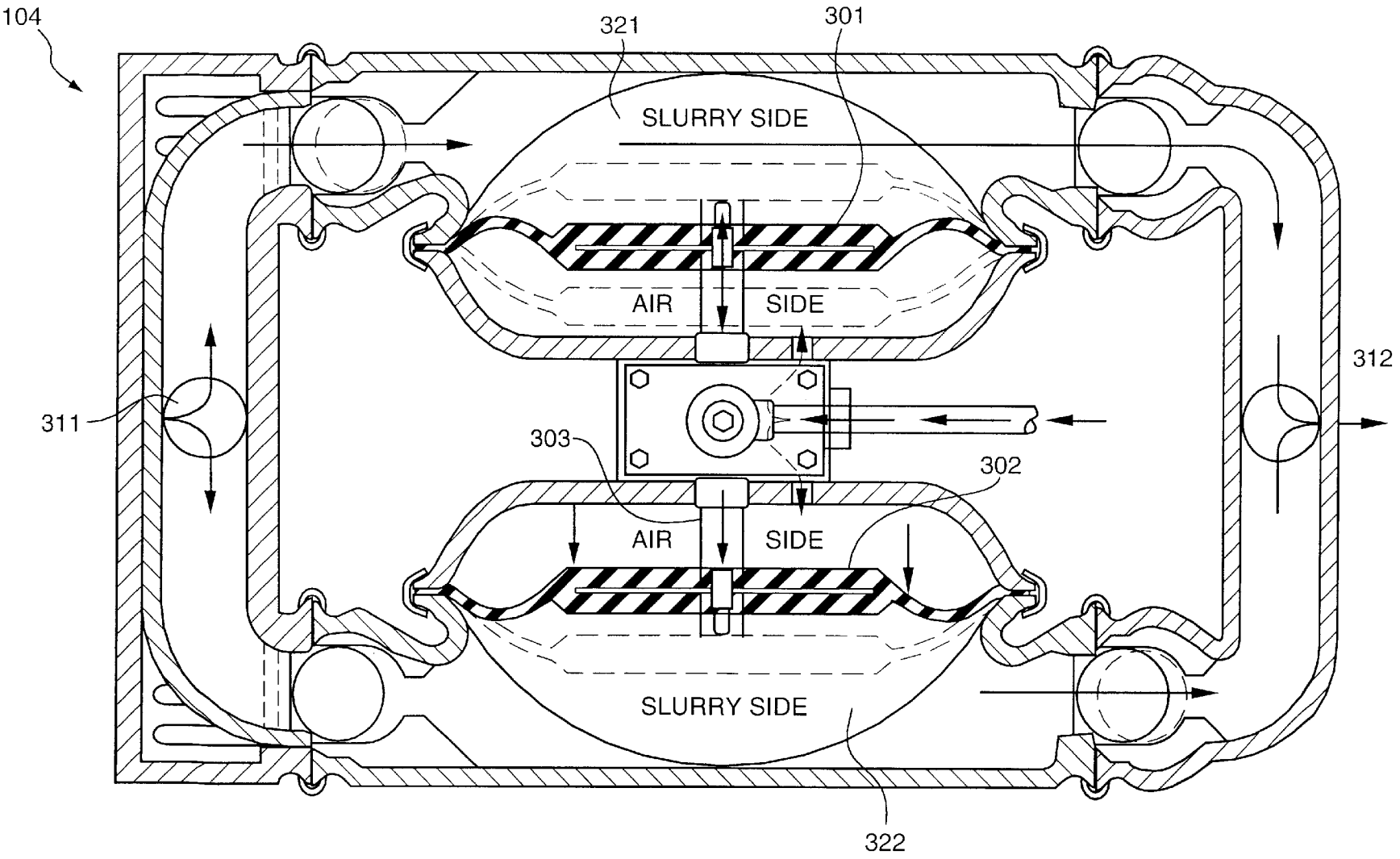
FIG. 9 illustrates a cross-sectional view of a typical pump that can be used in the implementation of the present foam based product solution delivery apparatus.

FIG. 9 illustrates a cross-sectional view of a typical pressurized gas driven pump 121, such as that presently available from Wilden Pump and Engineering Company and which is sold under various trade names. One model of Wilden pumps is sold under the trade name CHAMP™ which is an air operated double diaphragm non-metallic seal-less positive displacement pump. This pump is manufactured from polypropylene, polyvinylidine fluoride and Teflon® materials to provide chemical resistance, excellent mechanical properties and flex fatigue resistance in a lightweight inexpensive package. This pump can pump from 1/10 to 280 gallons/minute. These pumps are self-priming and variable capacity.

In operation, compressed gas is applied directly to the liquid column and is separated therefrom by a pair of elastomer diaphragms 301, 302. The diaphragms 301, 302 operate in opposition to provide a balanced load and create a steady pumping output. The product to be pumped, also called "slurry", is input at an inlet 311 located in the bottom of the pump 121 and drawn up into the liquid chamber by the operation of the diaphragms 301, 302. The two diaphragms 301, 302 are mechanically connected by arm 303 and operated by means of the air pressure supplied by a set of air valves (not shown). When a pressurized diaphragm 302 reaches the full limit of its stroke, forcing the slurry out to the outlet pipe 312 located at the top of the pump 121, an air valve is activated to shift the air supply pressure to the inner side of the opposite diaphragm 301. Meanwhile, when the pressurized diaphragm 302 is going through its active stroke, the other diaphragm 301 is being drawn inward, creating a suction to draw slurry into the liquid chamber 321 through the pump inlet 311. Check valves located in the pump inlet 311 and outlet 316 prevent a back flow between the diaphragms 301, 302 caused by the sequential operation of the two diaphragms 301, 302. Thus, the two diaphragms 301, 302 are cooperatively operative to create a suction in one fluid chamber 321 while pressurizing the second fluid chamber 322 to output a flow of the slurry. Simple air valves shift the pressurized gas to one or the other diaphragms 301, 302 dependent on the position of the diaphragms 301, 302 in their range of motion.

Agitation Apparatus

The agitation element 103 comprises the agitation apparatus 131 that functions to mechanically agitate the foam fluid as well as inject pressurized gas into the foam fluid. A pressurized gas supply line 132 is provided to draw the pressurized gas from supply line 116 and apply it via valve 133 to the agitation apparatus 131 where it is mixed with the water/foam mixture output by the water/foam mixture volume valve 123. The agitation apparatus 131 outputs a pressurized expanded foam mixture to outlet line 134 where it is propelled down the length of outlet line 134 by the action of the pressurized gas being added thereto via agitation apparatus 131. The fluid flow through agitation apparatus 131 causes the foam material to expand significantly in volume and move rapidly down the outlet line 134. The mechanical agitation of the foam fluid creates a highly uniform and small diameter bubble structure that provides a significant improvement over existing foam generation systems. The mechanical agitation prior to transmission of the foam down the hose 134 provides a significant increase in the magnitude and controllability of the expansion ratio of the foam.

Figure 2:
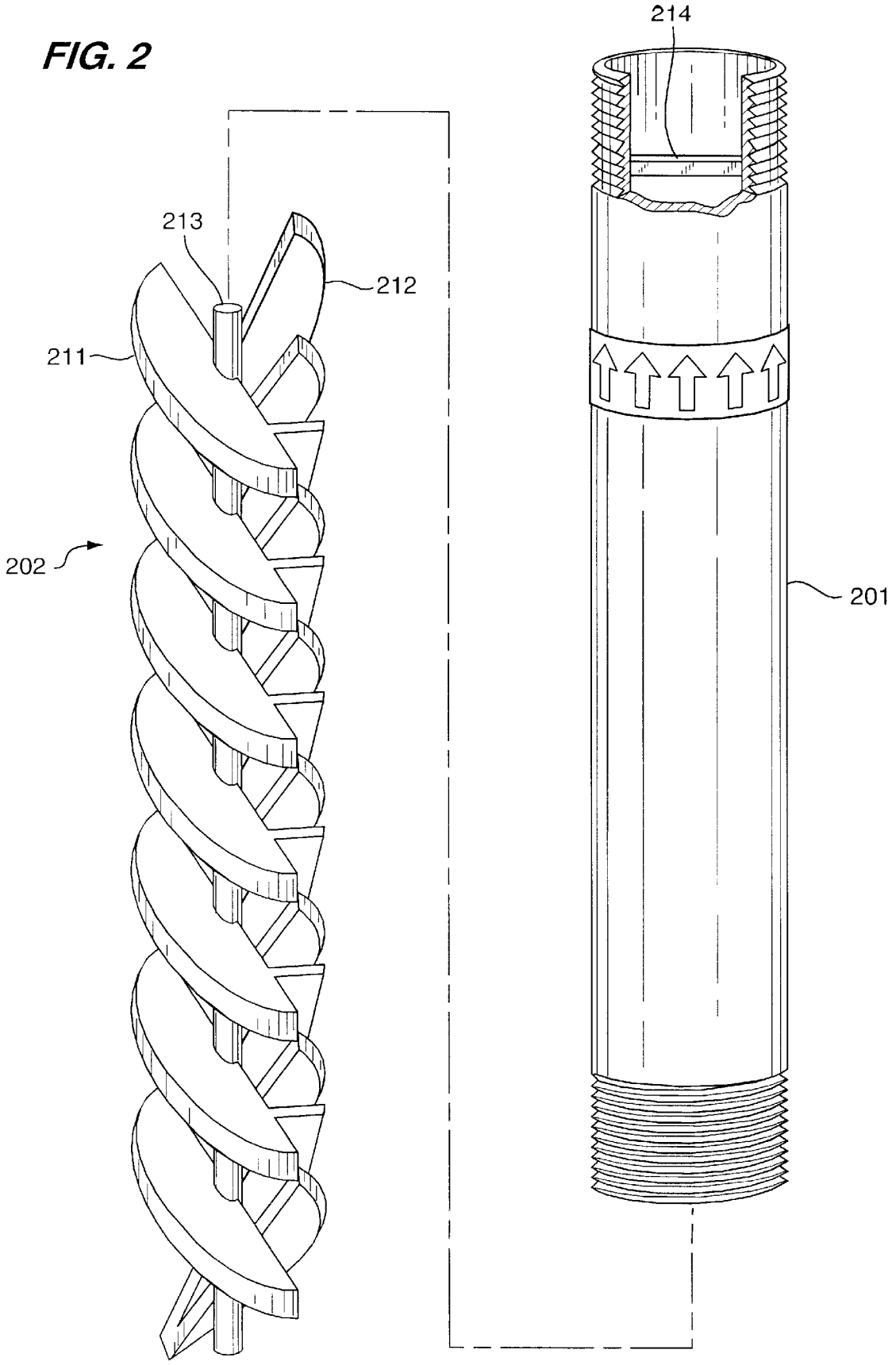
FIG. 2 illustrates a perspective, exploded view of the agitation apparatus.
Figure 3:
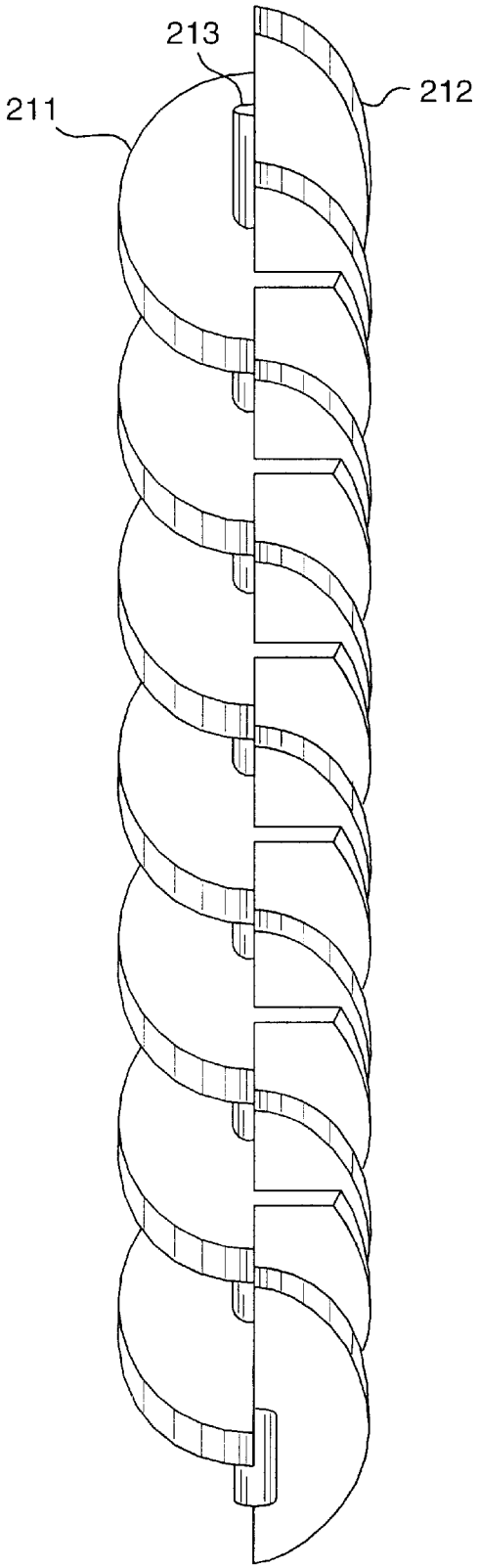
FIGS. 3–4 illustrate perspective views of a first embodiment of the foam mixing blades.
Figure 4:
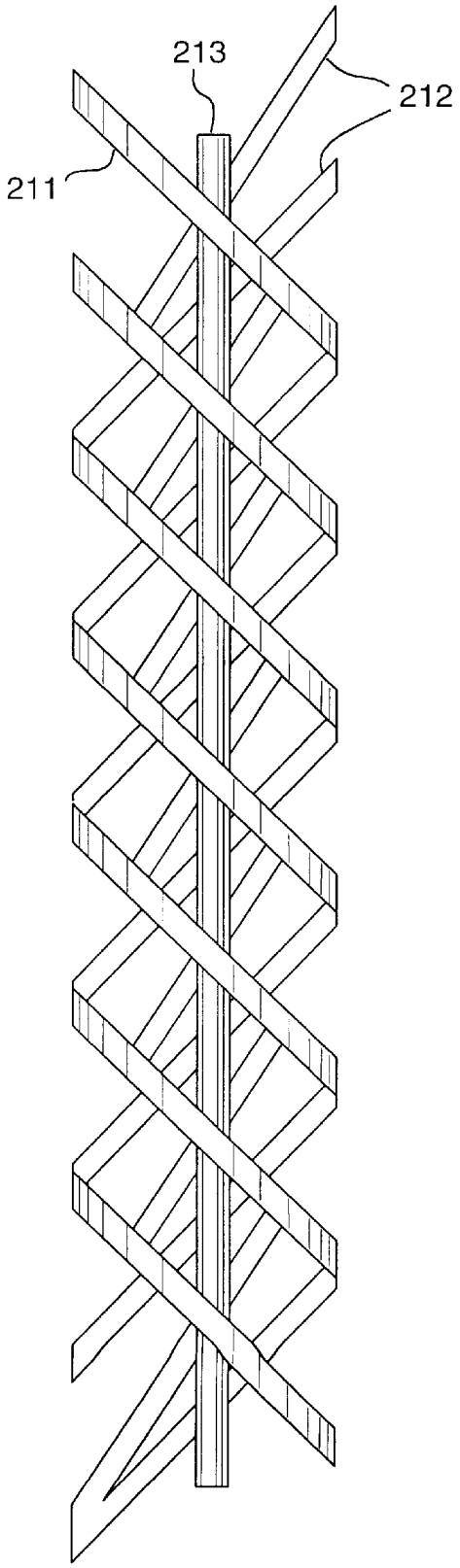
Figure 5:
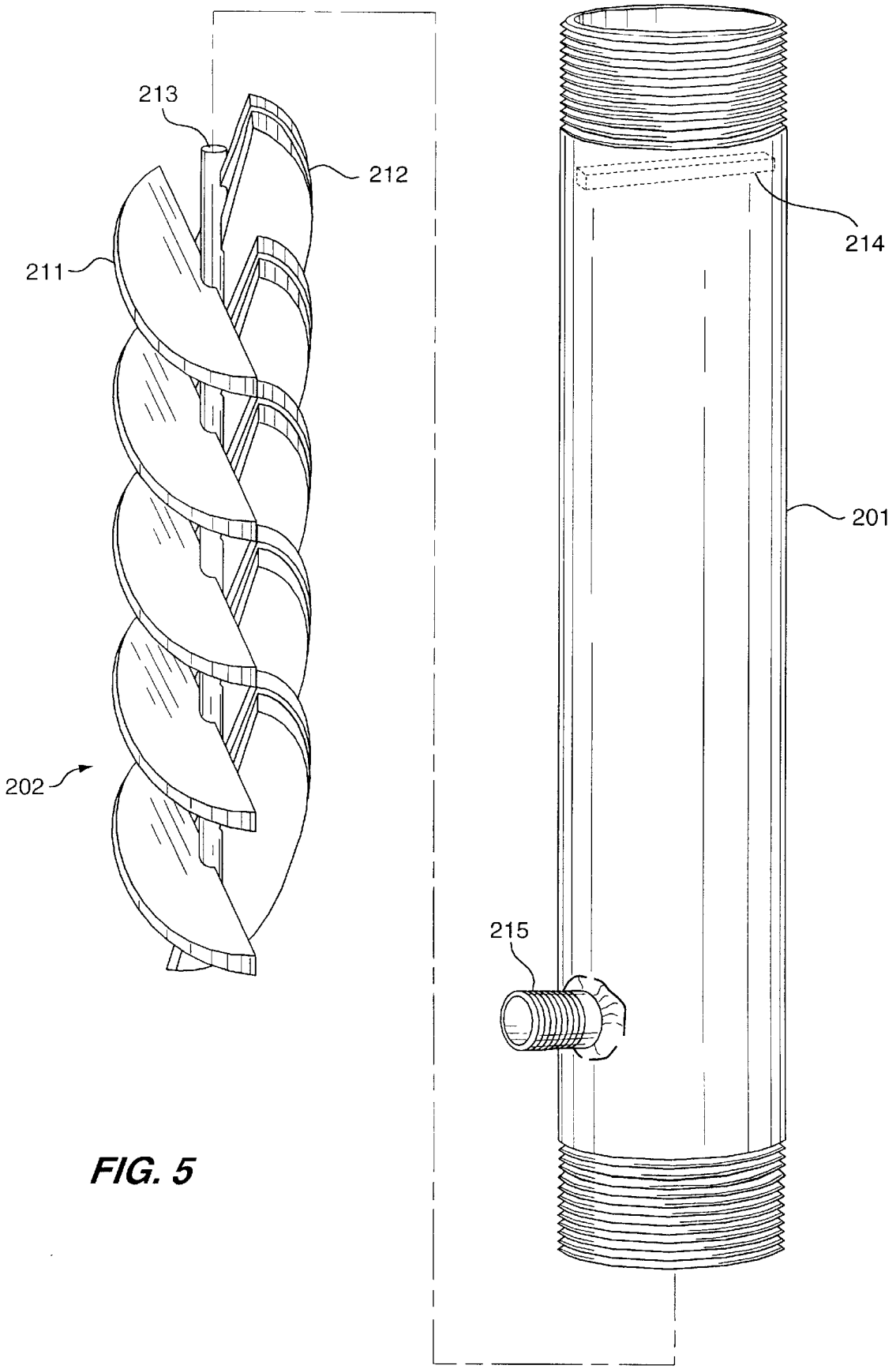
FIG. 5 illustrates a perspective, exploded view of a second embodiment of the agitation apparatus.
Figure 6:
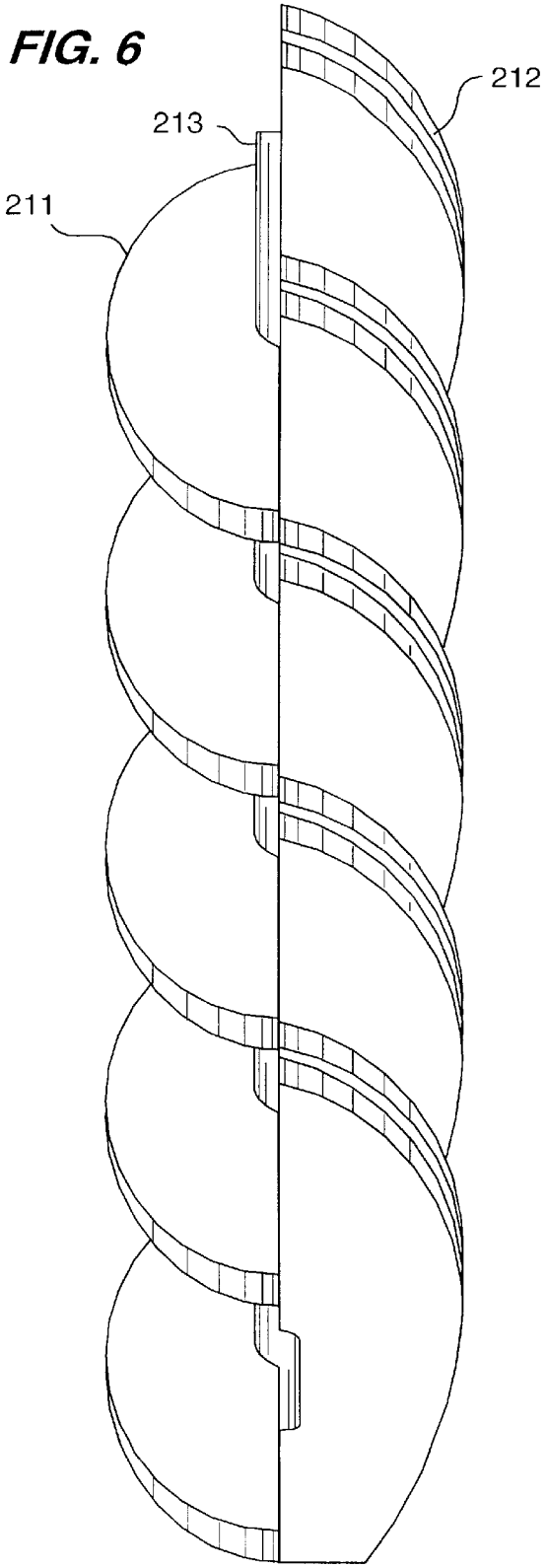
FIGS. 6–7 illustrate perspective views of a second embodiment of the foam mixing blades.
Figure 7:
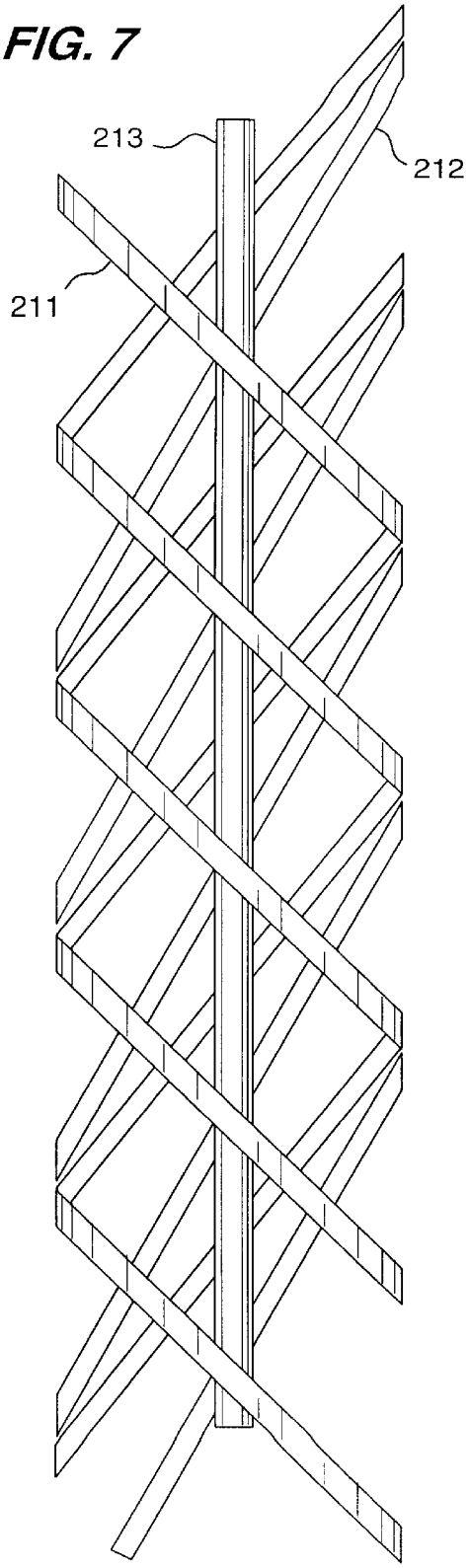

FIGS. 2 and 5 illustrate in perspective, exploded view two embodiments of the agitation apparatus 131. FIGS. 3–4, 6–7 illustrate perspective views of two embodiments of the mixing blades housed within the agitation apparatus 131. This apparatus comprises an external housing 201 having an interior channel extending form a first end to a second end thereof (with the direction of fluid flow being indicated by the arrows imprinted on exterior housing 201), inside of which is mounted a set of stationary blades 202 which function to mix and agitate the water-foam mixture. The external housing 201 in the preferred embodiment is cylindrical in shape to enable the coaxial mounting of the agitation apparatus 131 interposed between valve 132 and the delivery apparatus 104. The housing 201 is constructed from a durable material, such as stainless steel and, as shown in FIG. 2, is threaded on both ends thereof to enable the simple coupling of the agitation apparatus 131 to the tube 132 and valve 133.

The blades 202 comprise two sets of substantially semi-elliptical blade elements 211, 212, each set comprising a plurality of blade elements. The blade elements 211, 212 are attached to an axially oriented core element 213. A first set of blade elements comprises a plurality (n) of parallel oriented spaced apart blade elements 211 affixed at substantially the midpoint of the straight edge thereof to the core element 213 and aligned at an angle to the length of the core element 213. The second set of blade elements comprises approximately twice the number (m) of blade elements 212 as in the first set of blade elements and are oriented in a zig-zag pattern at an angle to the length of the core element 213. A first subset of the set of blade elements 212 comprises a plurality (m/2) of parallel oriented spaced apart blade elements 212 affixed at substantially the midpoint of the straight edge thereof to the core element 213 and at an angle to the length of the core element 213. The second subset of the set of blade elements 212 comprises a plurality (m/2, or m/2+1, or m/2−1) of parallel oriented spaced apart blade elements 212 affixed at substantially the midpoint of the straight edge thereof to the core element 213 and at an angle to the length of the core element 213. The first and second subsets of blade elements 212 are oriented so that the distal ends of each blade element 212 in a subset are located juxtaposed to the distal ends of adjacent blade elements 212 of the other subset, to form substantially a zig-zag pattern. The blade elements 212 in the first subset of blade elements 212 are oriented substantially orthogonal to the blade elements 211 when mounted on the core element 213. Typically, the number of blade elements in the first set (n) are equal to the number of blade elements in the first subset of the second set (m/2) which is also equal to the number of blade elements in the second subset of the second set (m/2). However, the number of blade elements in each grouping does not necessarily need to be the same as the number of blade elements in the other groupings.

The two sets of blade elements 211, 212 are mounted in external housing 201 in a stationary manner such that the curved side of each blade element 211, 212 snugly fits against the inside surface of the external housing 201. A retainer bar 214 is mounted inside external housing 201 and aligned to span the interior opening of exterior housing 201 substantially along a center line of the diameter of the interior opening, regardless of its geometry. The pressure generated by the foam mixture forces the blades 202 against retainer bar 214. The retainer bar 214 contacts the end of core element 213 and the endmost blade elements 211, 212 to prevent the blades 202 from moving down the length of exterior housing 201 beyond retainer bar 214 and to prevent the rotation of the blades 202 within the exterior housing. This configuration functions to divide the fluid flow through the agitation apparatus 118 into a number of segments, which swirl around the core element 213 as the flow traverses the length of the agitation apparatus 118. This division of the fluid flow and the concurrent swirling action causes the foam/water mix to mix evenly and simultaneously agitate the resultant mixture to cause the foam to expand. The use of the agitation apparatus 118 not only results in a high coefficient of expansion of the foam but it also produces a more consistent bubble structure which enhances both the longevity and adhesion of the foam when applied to a structure.

The agitation apparatus 131 of FIG. 2 differs from that illustrated in FIG. 5 by the presence of gas injector port 215 shown in FIG. 5. As illustrated in FIG. 1, the pressurized gas is injected into the foam fluid that is delivered by pump 102 to agitation apparatus 131. The agitation apparatus 131 of FIG. 2 utilizes an external fixture (not shown) mounted at the point where the foam fluid enters the agitation apparatus 131 while the agitation apparatus 131 of FIG. 5 incorporates this fixture in the form of gas injector port 215 into the basic structure of agitation apparatus 131. The gas injection takes place prior to the foam fluid encountering the blades 202 to thereby enable the pressurized gas to both propel the foam fluid through the agitation apparatus 131 as well as cause expansion of the foam fluid into the resultant foam.

Delivery Apparatus

The delivery apparatus 104 comprises a mechanism to transport the foam that is generated in the agitation apparatus 103 and enable the user to apply the foam to a desired application site. The delivery apparatus 104 can comprise an outlet line 141 as simple as a single length of hose, but its implementation can be that of a plurality of lines enclosed in a single outer covering. This implementation provides additional control over the bubble structure of the resultant foam, since bubble structure is a function of the diameter of the outlet line 141. Therefore, to achieve large volume delivery of the generated foam, it may be advantageous to feed the produced foam through multiple lines enclosed in a single sheath. The outlet line is typically terminated at the distal end thereof with a spray nozzle 142 to enable the user to regulate the flow of the foam through the outlet line 141 via a control valve integral to nozzle 142. A multitude of different types of output nozzles, such as mid and high volume output spray nozzles, can also be used.

Agricultural/Horticultural Applications

A particularly beneficial use of the foam that is produced by the foam based product solution delivery apparatus 100 is for agricultural and horticultural uses. In these environments, the application of herbicide, insecticides, fertilizers, dormant oil sprays, organic biological control solutions and the like are expensive processes and subject to difficult product application conditions. The foam that is produced by the foam based product solution delivery apparatus 100 can be used for enhanced crop protection results, since the duration of the foam can be precisely controlled to be from 1 day to 1 week. In addition, the application of product using foam is simplified by the visual feedback provided by the foam. There are specific instances where the foam based product solution can be used for multiple purposes. For example, dormant oil sprays are used on plants to kill both insect eggs and the insects that are on the branches and leaves of plants. This method of insect control is effective, but has a negative side effect of darkening the branches of the plants to which the dormant oil is applied. The increased darkness of the branches increases thermal collection and causes the plant to break dormancy earlier in the season. This can have undesirable consequences in the case of a late frost. In contrast, the foam-based product solution can be colored by the addition of various coloring agents to thereby precisely control the thermal absorption characteristics of the foam-based product solution to not only provide insect control but also dormancy control.

The foam-based product solution can also be used for frost protection. As noted in the case of use of the foam in a fire suppressant application, the thermal insulating properties of the foam are excellent. The application of a thin layer of the foam to plants in a frost condition provides ample thermal protection to the plants to avoid damage to the plants due to the frost. In addition, the foam is biodegradable and can simply be rinsed from the plants with a light spray of water without damaging the plants. The weight of the foam can be controlled by selecting the expansion ratio so that the weight of the foam does not damage the plants. In addition, the adhesion of the foam to vertical surfaces is excellent and the entirety of the plant can be protected, not just the horizontally oriented surfaces.

Fire Suppression Application

In this option, the use of the nitrogen gas has multiple benefits since the nitrogen gas is an inert element and does not support fire. One to six gallons of foaming concentrate is used for 100 gallons of water and, when mixed with high pressure air or nitrogen gas, a tremendous expansion of the foaming material takes place in the agitation apparatus to create the foam. This foam functions to extinguish the fire by means of a number of different characteristics. The small amount of detergent in the foaming agent enables the water to overcome the surface tension created by oils and dust normally found on interior and exterior surfaces. This allows the foam to penetrate and wet the flammable materials that comprise the structure much more quickly than the application of water alone. Also, because the foam is able to soak into the wood and vegetation instantly, evaporation is much less of a problem than the use of water that tends to pool on surfaces. The foam bubbles at the bottom of the foam wet and cool the surface that is to be protected. Furthermore, the top layer of the foam bubbles to provide a lingering cooling cover of oxygen-free insulation and heat reflection. The nitrogen gas that permeates the fire suppressant foam starves the fire of oxygen, therefore retarding the spread of the fire to the materials on which the foam has been applied. The foam therefore penetrates, cools and smothers the fire while the water would simply run off or evaporate in a similar application.

Thermal and Temporal Dynamics

Figure 11:
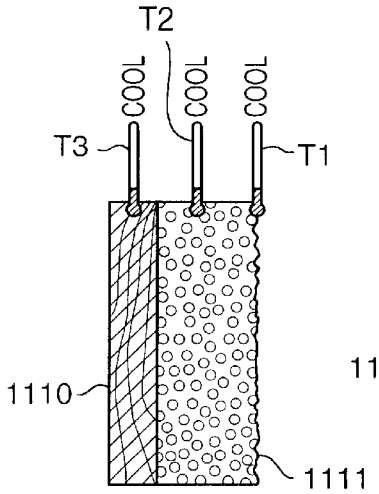
FIGS. 11–16 illustrate a cross-section view of the temporal and temperature characteristics of the foam based product solution delivery apparatus as applied to a combustible material.

A brief description of the temporal and thermal dynamics of the fire fighting foam is appropriate to thereby understand the benefits afforded by the various embodiments of the fire fighting foam generation apparatus disclosed herein. FIGS. 11–16 illustrate in cross-section view a temporal sequence of the temperature responsiveness of a combustible material overcoated with the fire suppressant foam generated by the apparatus of the present invention. In particular, section 1110 is a thickness of combustible material, such as a shed wall, typically made of laminated plywood or composition board. A thickness of fire fighting foam 1111 has been applied to the exterior surface of the combustible material 1110 to provide a barrier to a fire which would engulf the structure of which the combustible material 1110 is a part. The thermometer symbols T3–T1 indicate the relative temperature of the interior of the combustible material 1110, the interior of the fire fighting foam 1111 and the exterior, exposed surface of the fire fighting foam 1111, respectively. FIG. 11 illustrates the state of this combination prior to the arrival of the fire, with all layers being at a steady state ambient temperature.

Figure 12:
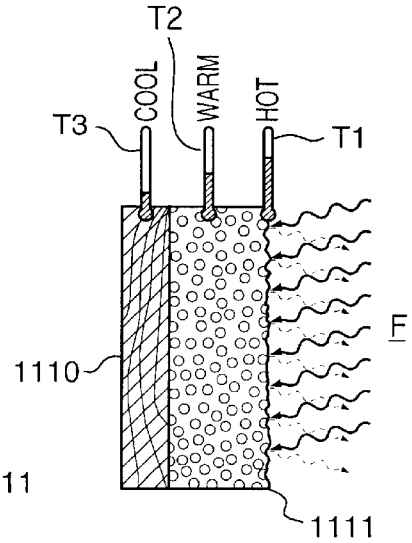
Figure 13:
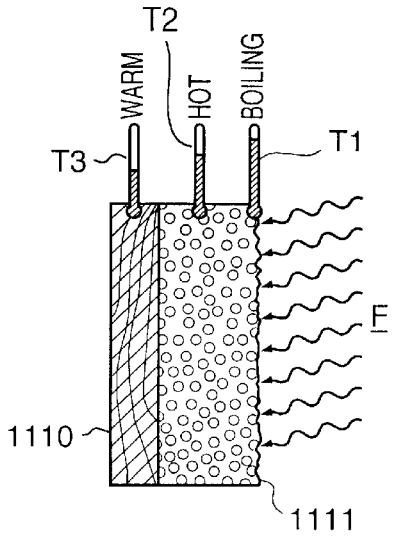
Figure 14:
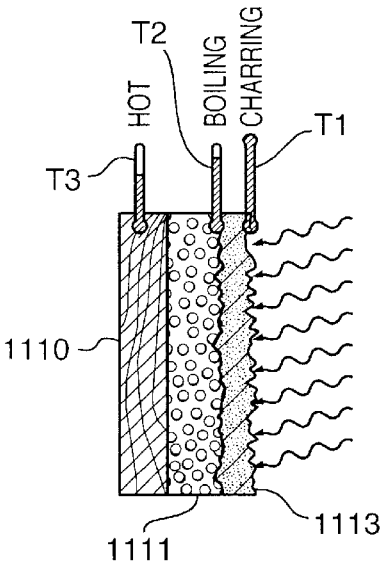
Figure 15:
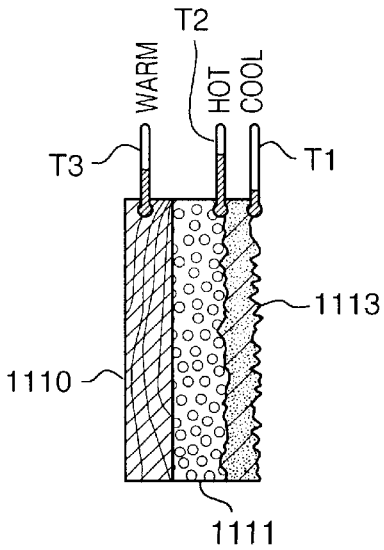
Figure 16:
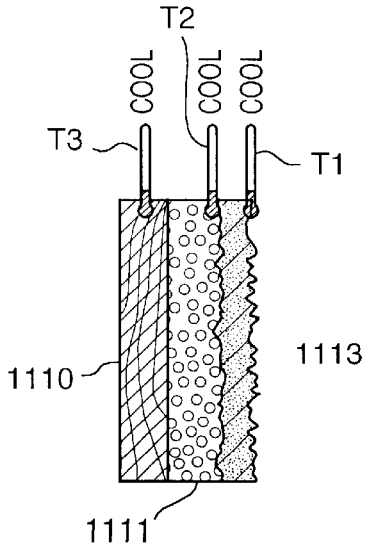

FIG. 12 illustrates the application of extreme heat (solid wavy lines) that is produced by a fire F, such as a wild fire, which produces temperatures in the range of 1300–2400 degrees Fahrenheit. The dotted lines radiating from the surface of the fire fighting foam 1111 represent heat reflected from the surface of the fire fighting foam 1111. As can be seen from the thermometers T1–T3 of FIG. 12 in the second time segment of this temporal sequence, the exposed surface of the fire fighting foam 1111 is subjected to high temperatures produced by the fire F and the low thermal conductivity of the fire fighting foam 1111 transfers only a fraction of the applied heat toward the combustible material 1110. The center of the fire fighting foam 1111 is elevated in temperature from the pre-fire state as shown by thermometer T2, but the combustible material 1110 still is not elevated in temperature as shown by thermometer T3. As shown in FIG. 13 in the third segment of the temporal sequence, as the fire F persists, the surface of the fire fighting foam 1111 boils when subjected to the extreme temperatures of the flames of the fire F since the fire fighting foam 1111 contains water. Steam is produced at the surface of the fire fighting foam 1111 and the interior of the fire fighting foam layer 1111 reaches a high temperature, as illustrated by thermometer T2. The combustible material 1110 is insulated from the extreme temperature of the flames but does rise in temperature as a function of the longevity of the fire F as shown by thermometer T3. FIG. 14 illustrates the next successive temporal view where the side of the fire fighting foam 1111 that is exposed to the fire F dries and turns to char 1113. The foam material therefore acts as a sacrificial material and is slowly consumed by the fire F over time until the fire F passes away from the structure or is extinguished. As can be seen from the thermometers T1–T3, the temperature elevates throughout the various layers (combustible material 1110, foam 1111, char 1113) compared to the previous temporal segments illustrated in FIGS. 11–13. In FIG. 15, the fire F has passed and the layers of material (combustible material 1110, foam 1111, char 1113) begin to cool. The combustible material 1110 remains protected and does not exceed 212 degrees Fahrenheit (thermometer T3) as long as a layer of foam 1111/char 1113 remains. As illustrated in FIG. 16, with the passage of time, the various layers (combustible material 1110, foam 1111, char 1113) return to the ambient temperature and the foam 1111 with its charred surface layer 1113 can be rinsed off with water, leaving the unscathed combustible material 1110 in its original state.

Permanently Installed Delivery Systems

Figure 10:
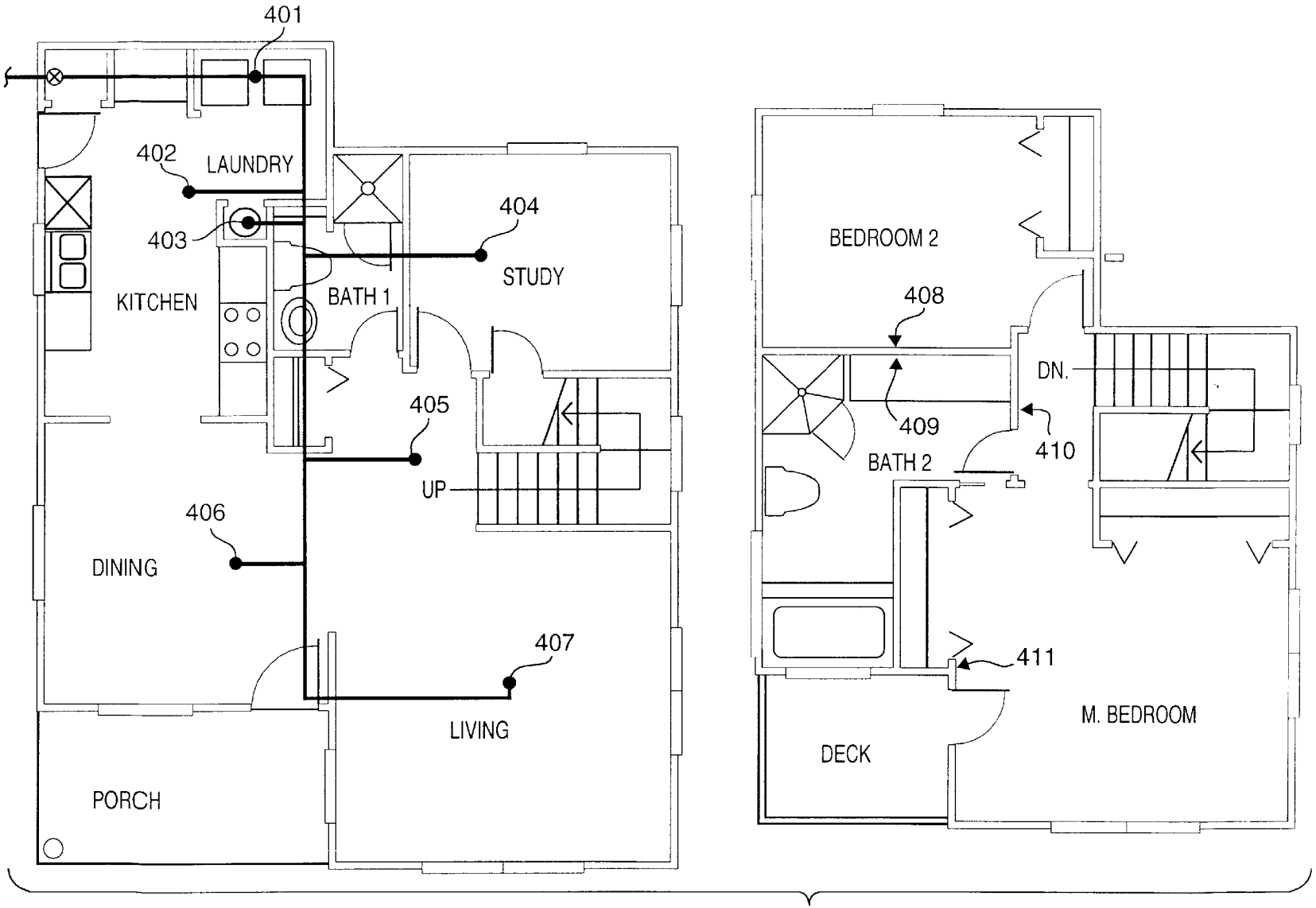
FIG. 10 illustrates a diagram of a residential installation of the foam based product solution delivery apparatus.

In addition to use with a manual delivery system as described above, the foam based product solution delivery system can be used with a permanently installed delivery system similar to conventional sprinkler systems used in residential and commercial buildings. An example of a typical residential sprinkler system is shown in FIG. 10 wherein a two-story residential structure has seven sprinkler heads 401–407 installed in the 717 square foot first floor of the structure and four additional sprinkler heads 408–411 installed in the 574 square foot second floor of the structure. Using standard design criteria for fire sprinkler systems, a flow rate of approximately 65 gallons of water per minute is required for effective fire fighting in such a system. It is obvious that this installation would be impractical in a wildland/urban interface environment since this volume of water is typically unavailable. In operation, this flow of water also causes a significant amount of water damage to the contents of the structure and also some damage to the structure itself if left in operation for a significant amount of time.

The water/foam mixture volume valve 124 in the fire suppressant foam generating apparatus 100 is used to regulate the moisture content of the resultant fire retardant foam that is produced. The water damage that results from dispensing fire retardant foam from the residential sprinkler system is thereby significantly reduced. The reduction of water damage is especially important in a business environment where numerous paper records are maintained. Therefore, the inlet 400 of the sprinkler system illustrated in FIG. 10 can be connected to outlet pipe 141 of the foam based product solution delivery apparatus 100 to obtain the benefits of the use of a low moisture content fire suppressant foam in a conventional residential fixed installation sprinkler system.

Backpack Unit

Figure 8:
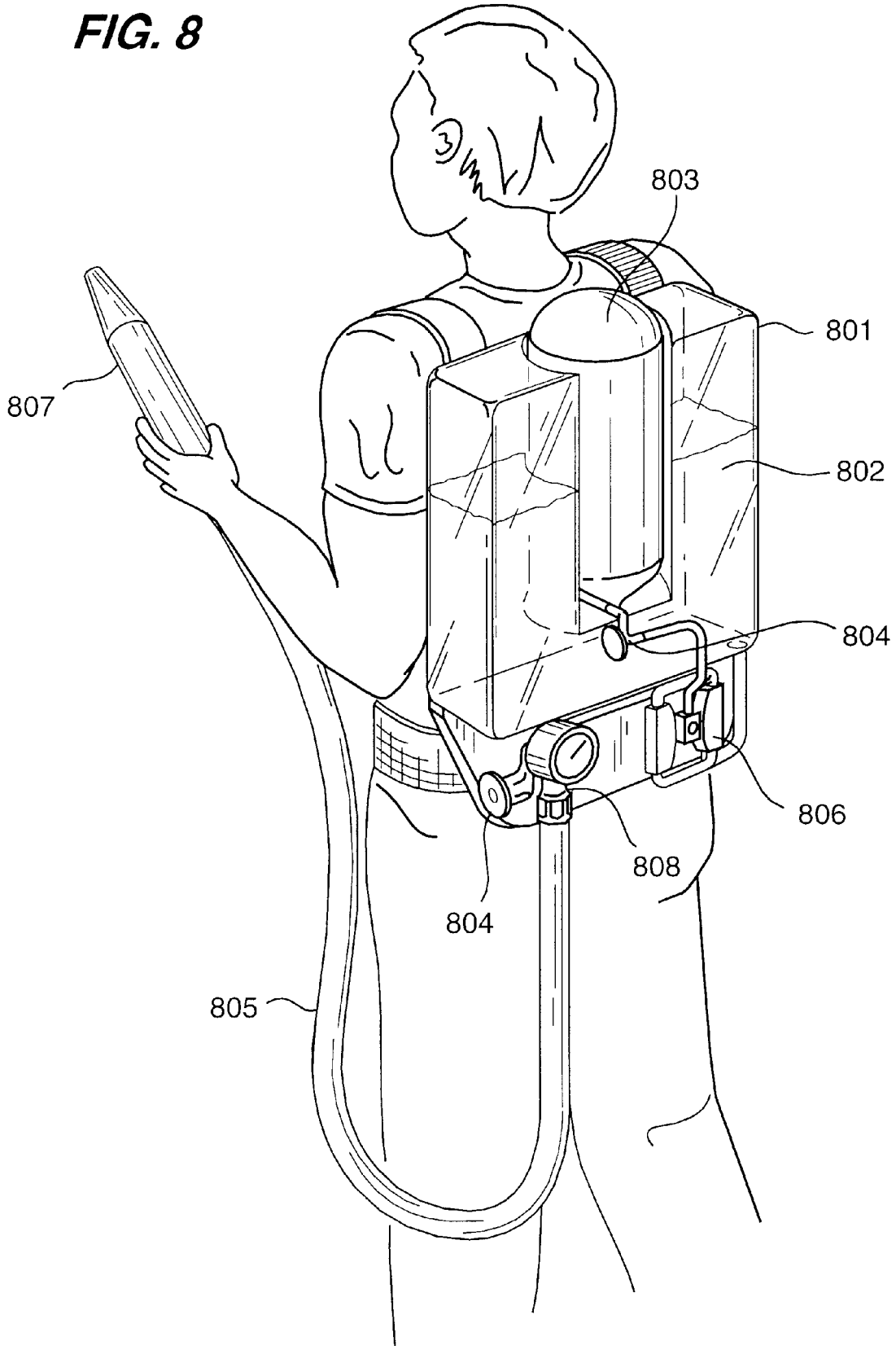
FIG. 8 illustrates a perspective view of a backpack embodiment of the present foam based product solution delivery apparatus.
Figure 22:
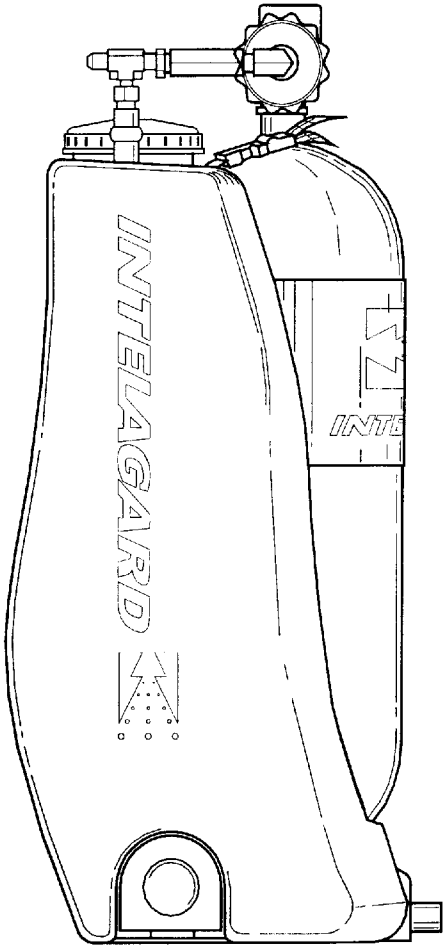
FIGS. 20–22 illustrate right side, front side and left side plan views respectively, of a modular version of a backpack embodiment of the present foam based product solution delivery apparatus.
Figure 21:
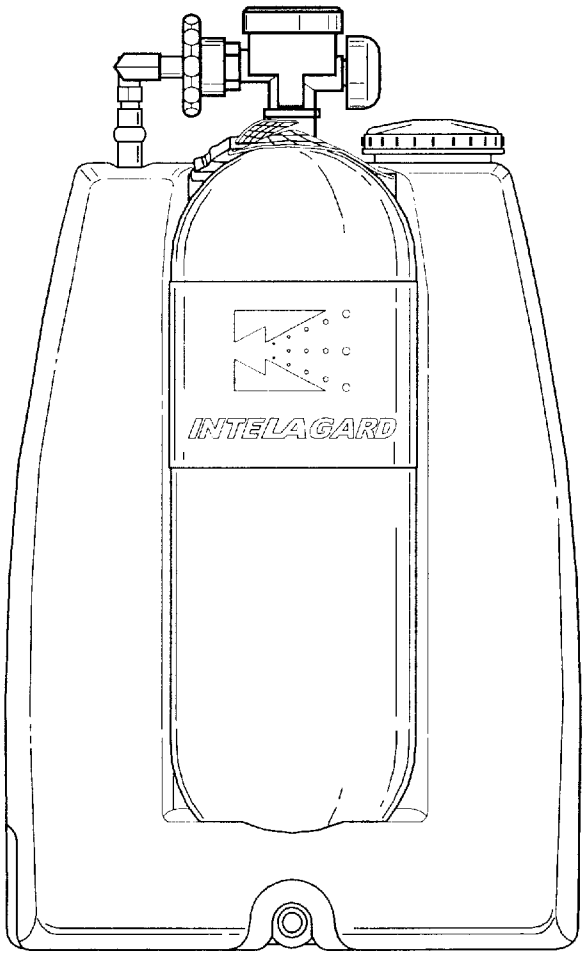
Figure 20:
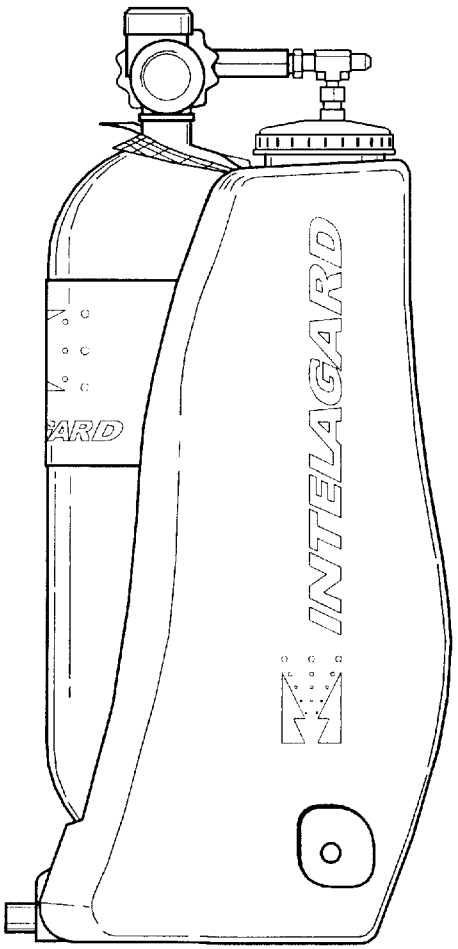

FIG. 8 illustrates in perspective view the architecture of a backpack embodiment of the foam based product solution delivery apparatus. FIGS. 20–22 illustrate right side, front side and left side plan views respectively, of a modular version of a backpack embodiment of the present foam based product solution delivery apparatus. This apparatus represents a scaled down version of the basic foam based product solution delivery system that is illustrated in FIG. 1. The backpack unit is intended for use by both professional fire fighters and laypersons. This unit is especially beneficial for smoke jumpers to fight spot fires in the forests; rural fire departments, farmers and ranchers for weed fires; and all fire fighters for structure fires. The unit consists of a storage tank, shown formed as a substantially U-shaped molded element 801, which contains the liquid foam concentrate/water mixture 802. A high pressure tank 803 containing pressurized gas, either nitrogen or a nitrogen-air mixture, or other suitable gas mixture, is included as shown in an aperture formed in the housing 801. The storage tank 801 and high pressure tank 803 are both connected to the control valves and regulator elements 804, with a miniature double diaphragm pump 806 being provided as with the system of FIG. 1. A short length of hose 805 with its attached nozzle 807, connected to agitation apparatus 808, are provided to enable the fire fighter to apply the generated foam to the fire.

An optional mouthpiece can be provided if the unit is charged with a breathable gas mixture in the high pressure tank 803, so the unit can perform a dual function of fire fighting foam generation apparatus as well as an emergency breathing system. The dimensions of all the apparatus in the backpack unit are proportionally scaled down from the full-sized system of FIG. 1 and provides an additional benefit of generating a more uniform bubble structure then the full size unit of FIG. 1 due to the smaller diameter delivery apparatus, comprising the agitation apparatus 808, hose 805 and nozzle 807. This resultant bubble structure produces a foam which lasts a long time and adheres to vertical surfaces exceptionally well.

Vehicle and Cart Mounted Units

Figure 19:
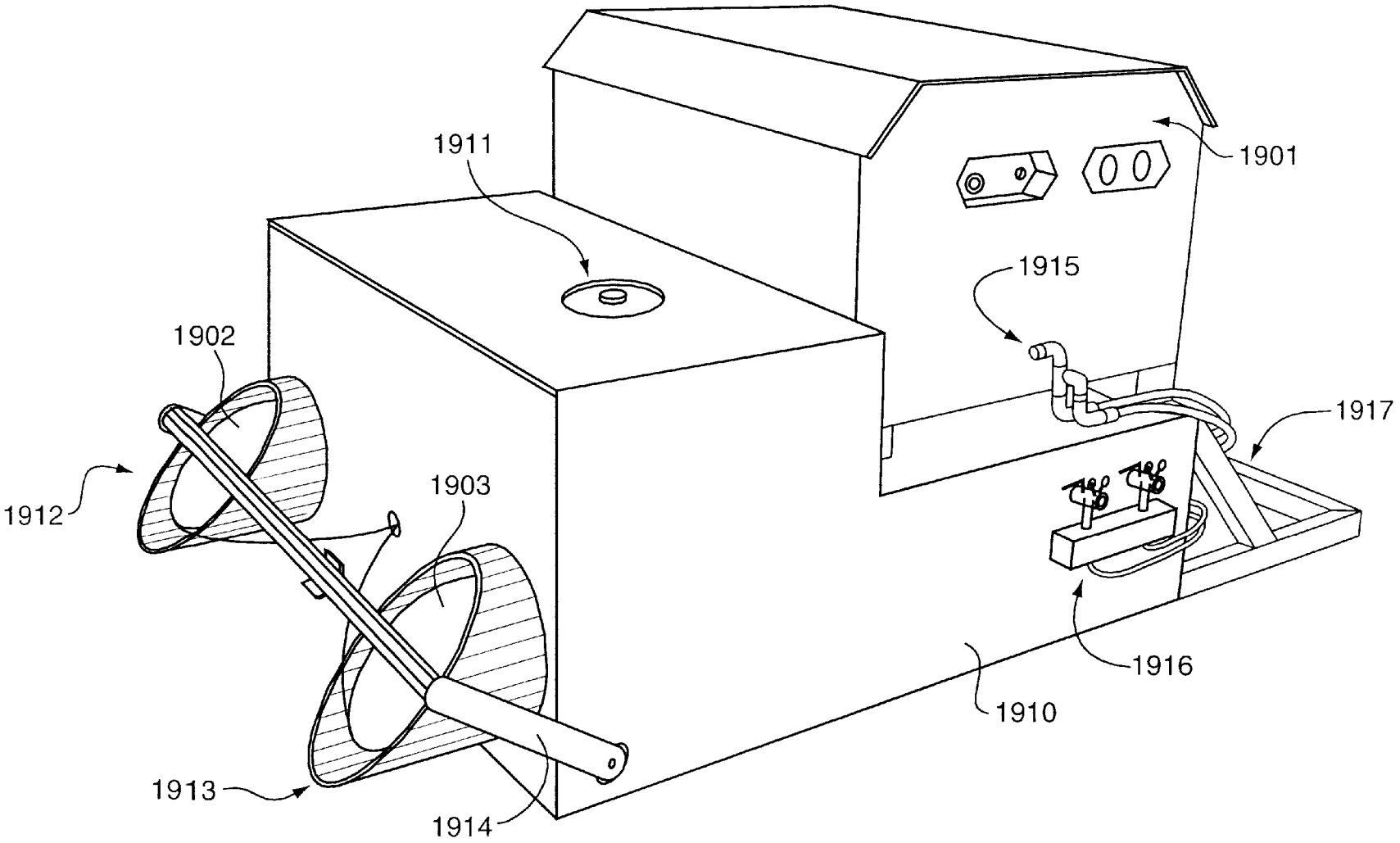
FIG. 19 illustrates in perspective view a truck or cart/trailer mounted embodiment of the present foam based product solution delivery apparatus.

FIG. 19 illustrates in perspective view a truck or cart/trailer mounted embodiment of the present foam based product solution delivery apparatus. This embodiment comprises the basic elements of the system disclosed in FIG. 1, as adapted for use in a truck or trailer environment. In particular, this unit is shown as embodying a fail-safe unit that provides both a compressor 1901 and a plurality of bottles 1902, 1903 of pressurized gas to provide the pressurized gas to power the unit as described above. The basic unit includes a tank 1910 that is manufactured of aluminum, plastic or fiberglass and that contains a plurality of internally mounted baffles to damp fluid movement therein. The tank 1910 is used to store the foam fluid and can be implemented to comprise the plurality of tanks noted above, or can be a single chamber tank. In either case, the tank 1910 includes a vented fill opening 1911 through which the user inputs the various fluids used in the system. The baffles in tank 1910 can comprise cylinders 1912, 1913 that project into the interior space of tank 1910 and that are used to store bottles 1902, 1903 of pressurized gas. There is provided a locking cylinder retention bar 1914 that pivots down to prevent the movement of bottles 1902, 1903 once they are inserted into cylinders 1912, 1913.

The top surface of tank 1910 is shown to include a shelf on which is mounted compressor 1901 that is fossil fuel powered to produce the pressurized gas as described above. In operation, the compressor 1901 is started and ball valve 1915 opened to engage the pressurized gas operated pump (not shown) and air injector in the agitation apparatus (not shown). The compressor 1901 is typically an adjustable air pressure system that is used to supply a constant air pressure to operate the system. If the compressor 1901 fails, the user can switch to the stored pressurized gas in bottles 1902, 1903 by manually closing ball valve 1915 and opening the valves on the bottles 1902, 1903. Alternatively, automatic switching between the two sources of pressurized gas can be effected by means of a pressure sensor that operates a switchable valve. The unit includes pre-set or adjustable block manifold and pressure regulators 1916 as described above. Finally, a shelf 1917 is provided on which is mounted the hose, pump, proportioner, and any other apparatus.

Summary

In summary, the present foam based product solution delivery system makes use of pressurized gas to power a dual diaphragm pressure operated pump to draw the water/foam-concentrate/product(s) from supply tank(s) and propel the resultant solution, with pressurized gas injected therein, through an agitation apparatus that mechanically agitates the water/foam/product(s) solution to create the foam based product solution for transmission to the foam delivery apparatus.

What is claimed is:

1. Apparatus for generating a foam based product comprising:

a source of a foam fluid, comprising:

first tank means for storing a water and foam concentrate mixture, second tank means for storing a product additive, other than water, mixing means, in fluid communication with said first tank means and said second tank means, for creating said foam fluid comprising a mixture of said water and foam concentrate mixture from said first tank means and said product additive from said second tank means;

means for producing a flow of said foam fluid;

means for agitating said foam fluid to generate a foam based product comprising a mixture of said water, said foam concentrate, and said product additive; and means for delivering said foam based product.

2. The apparatus of claim 1 wherein said first and said second tank means each has an output port for enabling fluid flow from said first and said second tank means through the respective said output port; and means for interconnecting said output ports of said first and said second tank means to create said foam fluid.

3. The apparatus of claim 2 wherein said means for interconnecting comprises:

a metering means connected to said output port of said second tank means for enabling a flow of a predetermined quantity of said product additive from said second tank means.

4. The apparatus of claim 1 wherein said source of a foam fluid comprises:

n tanks, where n is a positive integer greater than 2, each of said n tanks being operable for containing a fluid and each having an output port for enabling fluid flow from said tank through the respective said output port; and means for interconnecting said output ports of said n tanks to create a foam fluid comprising a mixture of said fluids contained in said n tanks.

5. The apparatus of claim 4 wherein said means for interconnecting comprises:

a plurality of metering means each connected to a corresponding said output port of one of said n tanks for enabling a flow of a predetermined quantity of said fluid from said one of said n tanks.

6. The apparatus of claim 1 wherein said means for producing a flow of said foam fluid comprises:

pump means for drawing said foam fluid from said source of foam fluid to create a flow of foam fluid at a controllable flow rate and pressure.

7. The apparatus of claim 6 wherein said pump means comprises:

a supply of pressurized gas; and pressurized gas operated pump means operable from said supply of pressurized gas to draw said foam fluid from said source of foam fluid to create a flow of foam fluid at a controllable flow rate and pressure.

8. The apparatus of claim 7 wherein said pump means further comprises:

compressor means for generating a supply of pressurized gas to drive said pressurized gas operated pump means.

9. The apparatus of claim 8 wherein said pump means further comprises:

valve means operable to interchangeable interconnect said supply of pressurized gas and said compressor means to said pressurized gas operated pump means to drive said pressurized gas operated pump means.

10. The apparatus of claim 7 wherein said supply of pressurized gas comprises:

at least one bottle operable to store gas under pressure;

manifold means for interconnecting said at least one bottle to a common pressurized gas output line; and regulator means connected to said manifold means for controllably outputting pressurized gas from said at least one bottle at a predetermined pressure.

11. The apparatus of claim 7 wherein said pressurized gas operated pump means comprises:

dual diaphragm, pressurized gas operated pump means.

12. The apparatus of claim 1 wherein said means for agitating comprises:

means for introducing a controllable quantity of pressurized gas into said flow of foam fluid; and means for mechanically inducing turbulence in said flow of said foam fluid to stimulate production of substantially uniform size bubbles.

13. The apparatus of claim 12 wherein said means for mechanically inducing turbulence comprises:

an exterior housing having an interior channel formed therein from a first end connected to said means for producing the flow of said foam fluid to a second end connected to said means for delivering, thereby forming a fluid path from said means for producing the flow of said foam fluid to said means for delivering through said interior channel; and stationary blade means mounted in said interior channel for agitating said foam fluid as it traverses said interior channel from said first end to said second end to produce said foam prior to output to said means for delivering.

14. The apparatus of claim 13 wherein said stationary blade means comprises:

a core element aligned substantially along the lengthwise axis of said interior channel; and a plurality of blade elements, each affixed to said core element and extending to an interior surface of said interior channel for forming a plurality of fluid paths extending substantially from said first end to said second end of said exterior housing.

15. The apparatus of claim 14 wherein said plurality of blade elements comprises:

i substantially semi-elliptically shaped elements aligned in a parallel oriented succession of blade elements mounted on a first side of said core element, wherein i is a positive integer greater than 1; and j substantially semi-elliptically shaped elements aligned in a zig-zag oriented succession of blade elements mounted on a second side of said core elements opposite said first side, wherein j is a positive integer greater than 1.

16. The apparatus of claim 1 further comprising:

a backpack frame for mounting said source of a foam fluid, said means for producing a flow of said foam fluid from said source of a foam fluid, said means for agitating, and said means for delivering.

17. The apparatus of claim 1 wherein said means for producing a flow of said foam fluid comprises:

a supply of pressurized gas; and pressurized gas operated pump means operable from said supply of pressurized gas to draw said foam fluid from said source of foam fluid to create a flow of foam fluid at a controllable flow rate and pressure;

said apparatus further comprises:

a backpack frame for mounting said source of a foam fluid, said supply of pressurized gas, said pressurized gas operated pump means, and said means for agitating.

18. The apparatus of claim 1 wherein said means for producing a flow of said foam fluid comprises:

a supply of pressurized gas; and pressurized gas operated pump means operable from said supply of pressurized gas to draw said foam fluid from said source of foam fluid to create a flow of foam fluid at a controllable flow rate and pressure;

wherein said apparatus further comprises:

a vehicle mountable frame for mounting said source of a foam fluid, said supply of pressurized gas, said pressurized gas operated pump means, and said means for agitating.

19. The apparatus of claim 1 wherein said means for producing a flow of said foam fluid comprises:

a supply of pressurized gas; and pressurized gas operated pump means operable from said supply of pressurized gas to draw said foam fluid from said source of foam fluid to create a flow of foam fluid at a controllable flow rate and pressure;

wherein said apparatus further comprises:

a cart mountable frame for mounting said source of a foam fluid, said supply of pressurized gas, said pressurized gas operated pump means, and said means for agitating.

20. The apparatus of claim 1 wherein said means for delivering comprises:

hose means having first and second ends for providing a fluid conduit from said first end to said second end, wherein said first end is connected to said means for agitating for receiving said foam; and nozzle means connected to said second end for controllably releasing said foam from said hose means.

21. The apparatus of claim 1 wherein said means for producing comprises:

a single valve means operable to activate said apparatus.

22. A method for generating a foam based product comprising the steps of:

storing a foam fluid, comprising:

storing a water and foam concentrate mixture in a first tank, storing in a second tank a product additive, other than water, mixing, using mixing apparatus which is in fluid communication with said first tank and said second tank, for creating said foam fluid comprising a mixture of said water and foam concentrate mixture from said first tank and said product additive from said second tank;

producing a flow of said foam fluid;

agitating said foam fluid to generate said foam based product comprising a mixture of said water, said foam concentrate, and said product additive; and delivering said foam based product.

23. The method of claim 22 wherein said step of mixing comprises:

enabling fluid flow from said first and said second tanks through respective output ports formed in said first tank and said second tank; and interconnecting said output ports of said first and said second tanks to create a foam fluid comprising a mixture of said said water and foam concentrate mixture and said product additive.

24. The method of claim 23 wherein said step of interconnecting comprises:

operating a metering means connected to said output port of said second tank for enabling a flow of a predetermined quantity of said product additive from said second tank.

25. The method of claim 22 wherein said step of storing comprises:

containing in n tanks, where n is a positive integer greater than 2, each of said n tanks being operable to contain a fluid and each having an output port for enabling fluid flow from said tank through the respective said output port; and interconnecting said output ports of said n tanks to create a foam fluid comprising a mixture of said fluids contained in said n tanks.

26. The method of claim 25 wherein said step of interconnecting comprises:

operating a plurality of metering means each connected to a corresponding said output port of one of said n tanks for enabling a flow of a predetermined quantity of said fluid from said one of said n tanks.

27. The method of claim 22 wherein said step of producing a flow of said foam fluid comprises:

operating a pump to draw said foam fluid from said tank to create a flow of foam fluid at a controllable flow rate and pressure.

28. The method of claim 27 wherein said step of operating said pump comprises:

providing a supply of pressurized gas; and operating a pressurized gas operated pump means from said supply of pressurized gas to draw said foam fluid from said source of foam fluid to create a flow of foam fluid at a controllable flow rate and pressure.

29. The method of claim 28 wherein said step of operating said pump further comprises:

generating a supply of pressurized gas to drive said pressurized gas operated pump means using a compressor.

30. The method of claim 29 wherein said step of operating said pump further comprises:

interchangeable interconnecting said supply of pressurized gas and said compressor to said pressurized gas operated pump to drive said pressurized gas operated pump.

31. The method of claim 28 wherein said step of providing a supply of pressurized gas comprises:

storing gas under pressure in at least one bottle;

interconnecting said at least one bottle to a common pressurized gas output line via a manifold; and connecting a regulator to said manifold for controllably outputting pressurized gas from said at least one bottle at a predetermined pressure.

32. The method of claim 22 wherein said step of agitating comprises:

introducing a controllable quantity of pressurized gas into said flow of foam fluid; and mechanically inducing turbulence in said flow of said foam fluid to stimulate production of substantially uniform size bubbles.

33. The method of claim 32 wherein said step of mechanically inducing turbulence comprises:

forming a fluid path in an exterior housing having an interior channel formed therein from a first end to a second end through said interior channel; and agitating said foam fluid as it traverses said interior channel from said first end to said second end using stationary blades mounted in said interior channel to produce said foam.

34. The method of claim 33 wherein said step of agitating comprises:

aligning a core element substantially along the lengthwise axis of said interior channel; and forming a plurality of fluid paths extending substantially from said first end to said second end of said exterior housing using a plurality of blade elements, each affixed to said core element and extending to an interior surface of said interior channel.

35. The method of claim 34 wherein said step of forming comprises:

aligning i substantially semi-elliptically shaped elements in a parallel oriented succession of blade elements mounted on a first side of said core element, wherein i is a positive integer greater than 1; and aligning j substantially semi-elliptically shaped elements in a zig-zag oriented succession of blade elements mounted on a second side of said core elements opposite said first side, wherein j is a positive integer greater than 1.

36. The method of claim 22 further comprising the steps of:

for mounting said tank, said pump, and said supply of pressurized gas on a backpack frame.

37. The method of claim 22 wherein said step of producing a flow of said foam fluid comprises:

providing a supply of pressurized gas; and operating a pressurized gas operated pump from said supply of pressurized gas to draw said foam fluid from said tank to create a flow of foam fluid at a controllable flow rate and pressure;

said method further comprises:

mounting said tank, said supply of pressurized gas, said pressurized gas operated pump on a backpack frame.

38. The method of claim 22 wherein said step of producing a flow of said foam fluid comprises:

providing a supply of pressurized gas; and operating a pressurized gas operated pump from said supply of pressurized gas to draw said foam fluid from said source of foam fluid to create a flow of foam fluid at a controllable flow rate and pressure;

wherein said method further comprises:

mounting said tank, said supply of pressurized gas, said pressurized gas operated pump on a vehicle mountable frame.

39. The method of claim 22 wherein said step of producing a flow of said foam fluid comprises:

providing a supply of pressurized gas; and operating a pressurized gas operated pump from said supply of pressurized gas to draw said foam fluid from said source of foam fluid to create a flow of foam fluid at a controllable flow rate and pressure;

wherein said method further comprises:

mounting said tank, said supply of pressurized gas, said pressurized gas operated pump on a cart mountable frame.

40. The method of claim 22 wherein said step of delivering comprises:

connecting a first end of a hose having first and second ends for providing a fluid conduit from said first end to said second end to receive said foam; and connecting a nozzle to said second end of said hose for controllably releasing said foam from said hose.

41. The method of claim 22 wherein said step of producing comprises:

operating a single valve to generate said foam product.

* * * * *